US010443132B1

(12) United States Patent
El-Eskandarany et al.

(10) Patent No.: US 10,443,132 B1
(45) Date of Patent: Oct. 15, 2019

(54) METHOD FOR DOPING MAGNESIUM WITH NICKEL BY COLD SPRAY TECHNIQUE

(71) Applicant: KUWAIT INSTITUTE FOR SCIENTIFIC RESEARCH, Safat (KW)

(72) Inventors: Mohamed Sherif Mohamed Mostafa El-Eskandarany, Salmya (KW); Mohammad E. A. A. Banyan, Abdullah Al-Mubarak (KW); Fahad Talal Mohammed Ali Salem Alajmi, Hadiya (KW)

(73) Assignee: Kuwait Institute for Scientific Research, Safat (KW)

( * ) Notice: Subject to any disclaimer, the term of this patent is extended or adjusted under 35 U.S.C. 154(b) by 0 days.

(21) Appl. No.: 16/278,685

(22) Filed: Feb. 18, 2019

(51) Int. Cl.
*C23C 24/04* (2006.01)

(52) U.S. Cl.
CPC ..... *C23C 24/04* (2013.01)

(58) Field of Classification Search
None
See application file for complete search history.

(56) References Cited

U.S. PATENT DOCUMENTS

| | | | | |
|---|---|---|---|---|
| 3,382,085 | A | 5/1968 | Wren et al. | |
| 5,576,118 | A | 11/1996 | Zhang et al. | |
| 2006/0240192 | A1* | 10/2006 | Raybould | C23C 24/04 427/367 |

FOREIGN PATENT DOCUMENTS

| | | | |
|---|---|---|---|
| CN | 1296083 | A | 5/2001 |
| CN | 103540960 | A | 1/2014 |
| CN | 104988344 | A | 10/2015 |
| JP | 2003221202 | A | 8/2003 |

OTHER PUBLICATIONS

Lieva et al.; Magnesium-Nickel Alloy for Hydrogen Storage Produced by Melt Spinning Followed by Cold Rolling; Materials Research 2012 15(5): 813-817 (Year: 2012).*
Leiva et al., "Magnesium-Nickel Alloy for Hydrogen Storage Produced by Melt Spinning Followed by Cold Rolling", Materials Research (2012), 15(5), pp. 813-817.
Chang et al., "Reviews on the U.S. Patents Regarding Nickel/Metal Hydride Batteries", Batteries (2016), 2, 10 (29 pages).

* cited by examiner

*Primary Examiner* — Michael P. Rodriguez
(74) *Attorney, Agent, or Firm* — Richard C. Litman

(57) ABSTRACT

The method for doping Mg with Ni includes cold-rolling the Mg material and then cold-spraying with Ni powder, and preferably further cold rolling the Ni-coated Mg to achieve the final Ni-doped Mg material. Preferably the Mg material is cold rolled for about 300 passes and the final Ni-doping concentration is about 5 wt. %.

4 Claims, 12 Drawing Sheets

METHOD FOR DOPING MAGNESIUM WITH NICKEL BY COLD SPRAY TECHNIQUE

BACKGROUND OF THE INVENTION

1. Field of the Invention

The present invention relates to enhancing magnesium's storage capacity for hydrogen for use in fuel cells and other alternative energy sources, and particularly to a method for doping magnesium with nickel by cold spray technique to improve the hydrogen storage capacity of magnesium.

2. Description of the Related Art

Hydrogen is a convenient, safe, and efficient fuel source that can be easily converted to a desired form of energy without releasing harmful emissions. Magnesium hydride ($MgH_2$) has been widely studied with regard to its use as a hydrogen storage medium due to its natural abundance, material and operational cost effectiveness, light weight, and high hydrogen storage capacity.

$MgH_2$ readily reacts with water to form hydrogen gas: $MgH_2+2H_2O \rightarrow 2H_2+Mg(OH)_2$. $MgH_2$ powders have been successfully produced near room temperature by reactive ball milling technique (RBM), using a high-energy ball mill operated at hydrogen atmospheric pressure. However, due to the high thermal stability of $MgH_2$, magnesium hydride releases little hydrogen at temperatures below 350° C. and exhibits prohibitively slow hydrogenation/dehydrogenation kinetics at temperatures less than 400° C. As such, there is significant interest in improving the hydrogenation and dehydrogenation reaction kinetics of magnesium and $MgH_2$. Prior efforts in improving the hydrogenation and dehydrogenation reaction kinetics of $MgH_2$ have not resulted in significant improvement and/or have generally required the use of complex and costly additional machinery and equipment.

Three primary strategies have been pursued at achieving $MgH_2$-based systems for hydrogen storage with improved hydrogenation/dehydrogenation behaviors.

The first strategy is based on doping the $MgH_2$ powders with selected catalysts and/or nanocatalysts to form ultrafine nanocomposite powders with advanced hydrogenation/dehydrogenation properties. A wide variety of nanocatalysts, such as pure metals, intermetallic compounds, metal oxides, metal/metal oxide nanocomposite, metal carbides and metal chlorides have been incorporated into such nanocomposite powder systems. Almost all such reported systems, when compared with pure $MgH_2$ nanocrystalline powders, showed lower hydrogen sorption/desorption temperatures and faster hydrogenation/dehydrogenation kinetics.

The second strategy is based on melting pure bulk Mg with selected alloying elements (such as Ni, Pd, and Nd) to obtain less stable binary, ternary or multicomponent Mg-based alloy systems with lower heat of formation ($\Delta H_{for}$). Such Mg-based alloy systems have typically not shown overall improved properties relative to pure $MgH_2$. For example, alloying Mg with Ni to form binary $Mg_2Ni$ lowers the $\Delta H_{for}$ of the metal hydride phase $Mg_2NiH_6$ to −64.5 $kJmol^{-1}$, instead of −74.5 $kJmol^{-1}$ for pure $MgH_2$. However, the alloy system shows significantly decreased hydrogen storage capacity (down to 3.5 wt. % from ~5 wt. %), with no significant decrease in decomposition temperature.

The third strategy depends on introducing a heavy network of lattice imperfections and defects to Mg, pure $MgH_2$ or Mg-based alloys without the use of catalysts. Mechanical introduction of defects has been successfully achieved by subjecting initial materials in powder form to long-term high-energy ball milling, through mechanically induced cyclic phase transformations. β-γ and cyclic β-γ-β phase transformations are accompanied with significantly decreased grain sizes of $MgH_2$ powders. Since hydrogen diffusion along grain boundaries is much faster than diffusion in side grains, the hydrogen-ation/dehydrogenation kinetics of $MgH_2$ are significantly improved upon producing such fine nanostructured grains, which contain a large number of grain boundaries. Severe plastic deformation, for example, using cold rolling, equal channel angular pressing, high-pressure torsion multiple forging and channel die compression, are other powerful options for refining coarse $MgH_2$ grains to obtain nanostructured grains, leading to faster kinetics when compared with plain ball milled samples.

Thus, a method for doping magnesium with nickel by cold spray technique solving the aforementioned problems is desired.

SUMMARY OF THE INVENTION

A method for doping magnesium with nickel by cold spray technique includes cleaning initial magnesium (Mg) material, for example, cleaning Mg rods with acetone, rinsing them with ethanol and then drying them in a vacuum furnace at 150° C. overnight. The clean Mg is then cold rolled in a rolling machine, preferably for an initial two passes, and then placed between two stainless steel sheets and further cold rolled from 1 to 300 passes at room temperature to form Mg ribbons. The Mg ribbons may be cleaned, preferably again with acetone, rinsed with ethanol and then dried in a vacuum furnace at 150° C. overnight. The dried Mg ribbons may then be straightened, for example, by pressing and/or further cold rolling passes, and preferably by wrapping in balance papers and pressing in a two jaw device for 16 hours, followed by cold rolling for 10 passes.

The cold-rolled Mg ribbons are then placed in the jaws of a cold spray machine. Nickel (Ni) powder, preferably with an average size of 10 μm, is fed to the cold spray machine, and the Mg ribbons are coated with from 1-3 layers of Ni powder, resulting in Ni-doped Mg material. To improve weldability of the Ni-doped Mg ribbons, they may be further cold rolled, for example by being placed in a stainless steel tube and cold rolled at room temperature for 30 passes. The stainless steel tube may then be snipped to remove the Ni-doped Mg material. The method of forming the Ni-doped Mg material is considerably less expensive than the current ball milling methods used to produce Mg-based materials for hydrogen storage, and the resulting Ni-doped Mg material are capable of absorbing hydrogen at lower temperatures and pressures.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
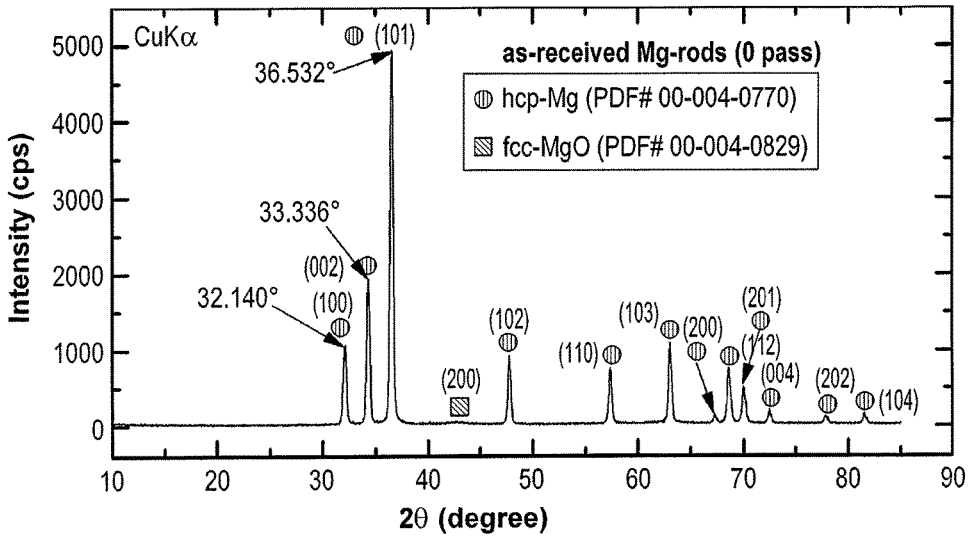
FIG. 1A is the X-ray diffraction (XRD) pattern of magnesium rods before cold rolling.

The method for doping magnesium with nickel by cold spray technique may include cleaning initial magnesium (Mg) material, for example, cleaning Mg rods with acetone, rinsing them with ethanol, and then drying them in a vacuum furnace at 150° C. overnight. The clean Mg is then cold rolled in a rolling machine, preferably for an initial two passes and then placed between two stainless steel sheets and further cold rolled from 1 to 300 passes at room temperature to form Mg ribbons. The Mg ribbons may be cleaned, preferably again with acetone, rinsed with ethanol and then dried in a vacuum furnace at 150° C. overnight. The dried Mg ribbons may then be straightened, for example, by pressing and/or further cold rolling passes, and preferably by wrapping in balance papers and pressing in a two jaw device for 16 hours, followed by cold rolling for 10 passes.

The cold rolled Mg ribbons are then placed in the jaws of a cold spray machine. Nickel (Ni) powder, preferably with an average particle size of 10 μm, is fed to the cold spray machine, and the Mg ribbons are coated with preferably from 1-3 layers of Ni powder, resulting in Ni-doped Mg material. To improve weldability of the Ni-doped Mg ribbons, they may be further cold rolled, for example, by being placed in a stainless steel tube and cold rolled at room temperature for 30 passes. The stainless steel tube may then be snipped to remove the Ni-doped Mg material. The method of forming the Ni-doped Mg material is considerably less expensive than the current ball milling methods used to produce Mg based materials for hydrogen storage, and the resulting Ni-doped Mg material are capable of absorbing hydrogen at lower temperatures and pressures.

The method will be further explained in the following examples. The following is a description of the starting materials and equipment used in the subsequent exemplary procedures:

The starting materials included the following: Magnesium (Mg) rods, 90 cm in length, 0.8 cm in diameter and 99.99 wt. % purity; Nickel (Ni) powder, average particle size of 10 μm in diameter and 99.99 wt. % purity; Stainless steel (SUS 304) smoothie tubes, 18 cm in length and 8 mm wide opening diameter; Argon gas (Ar) cylinders having 99.999% purity (provided by a local gas company in Kuwait); and Hydrogen gas ($H_2$) cylinders having 99.999% purity, (provided by a local gas company in Kuwait).

The equipment, devices, and tools for sample preparation included the following: Two-drum type manual cold rolling machine with 110 mm wide×55 mm diameter rollers; provided with 4:1 reduction gearbox; Quick release drill vise, 15 cm in width; Heavy-duty metal cutting straight shear scissors with spring and 3.75 cm cutting blade; Brass metal stamping hammer; Cold spray system (Startack Co. Ltd., Japan) consisting of a powder feeder connected by reinforced polymer tubing to the head of the gun (cold rolled Mg strips were fixed on a sample holder transported by a robot during the coating process and facing a gun with an expansion copper nozzle, which is oriented to horizontally face the target Mg strip); and He-gas atmosphere-glove box (UNI-LAB Pro Glove Box Workstation, provided by mBRAUN, Germany).

Equipment devices, and tools for sample characterization included the following: X-ray diffraction (XRD) with CuKa radiation, (9 kW Intelligent X-ray diffraction system, Smartlab-Rigaku, Japan); 200 kV-field emission high resolution transmission electron microscopy (FE-HRTEM)/scanning transmission electron microscopy (STEM) (JEOL-2100F, Japan), equipped with Energy-dispersive X-ray spectroscopy (EDS) capability (Oxford Instruments, UK); Differential scanning calorimeter (DSC) (Shimadzu Thermal Analysis System/TA-60WS) for determining decomposition temperatures of $MgH_2$-based composite powders with heating rate of 20° C./min; High pressure DSC (HPDSC; Setaram Instrumentation, France), employed under 30 bar of hydrogen gas atmosphere with different heating rates in order to demine the activation energy of hydrogenation;] Gas-sorption station (PCTPro-2000; Setaram Instrumentation, France) employed under hydrogen gas pressure in the range between 200 mbar to 8 bar to investigate adsorption/ desorption kinetics via Sievert's method; and 15 kV-field emission scanning electron microscope (FE-SEM, JSM-7800F, Japan) equipped with EDS supplied by Oxford Instruments, UK) used to determine morphological properties of produced powders after selected MA times.

Example 1

Preparation of Nanocrystalline Magnesium Ribbon Strips

The Mg rods were snipped to three equal shorter rods of 30 cm in length and cleaned with acetone followed by ethanol before drying in a furnace under vacuum at 150° C. overnight. The rods were straightened by passing through the drums of the two-drum cold rolling machine twice. The straightened rods were inserted between two sheets (5 mm thick) of stainless steel (316L) and cold rolled for a desired number of passes, ranging from 1-300, at room temperature. The cold rolled Mg obtained after different pass numbers were cut into thin ribbon strips with an average length of 80 mm, width of 5 mm and thickness of 2 mm. The ribbons were cleaned with acetone to remove any oil contamination on the surfaces, and then rinsed with ethanol before drying at 150° C. under vacuum (~$3\times10^{-2}$ bar) in a temperature-controlled furnace overnight. The dried Mg ribbons were then wrapped in balance papers and placed between a two jaw type vise for 16 h. Then, the ribbons were cold rolled 10 times to ensure Mg ribbons were straightened.

Example 2

Cold Spraying with Nickel Powder

Seven strips of straightened Mg ribbons were then fixed by paper clips on a stainless steel (SUS 316L) sheet (5 cm L×−5 cm W×0.5 cm D). The stainless steel sample holder sheet was then fixed between two jaws on the cold sprayer sample stage. Commercial high purity (99.99 wt. %) Ni powder with particle size of ~10 μm in diameter was charged in the cold spray feeder and subjected to high pressure argon gas flow, thereby passing through a reinforced polymer tube connected to a supersonic jet. Each face of the seven ribbons was then coated by cold spraying 1 time with the Ni powder to obtain a given Ni wt. %. New Mg ribbons were then coated with 2 and 3 nickel layer coatings on each face. The Mg ribbon strips, once coated by Ni powder, had a sandwich-like morphology, in which the opposite faces of Mg ribbons were coated by Ni powder. The Mg strips obtained after cold spraying with Ni powders had porous morphology with a rough surface, as shown by FE-SEM micrographs. In order to improve the weldability of the Ni powder deposited on the Mg ribbon surfaces, a steel tube (SUS304) was sealed with a Ni-coated Mg ribbon and then cold rolled gently at room temperature 30 times. The two opposite short ends of the steel tube were carefully snipped, and the upper and lower walls were gently opened. Then, the exemplary Ni-coated Mg ribbon was carefully removed from the steel tube for use, or subjected to the following different characterization experiments.

Example 3

Crystal Structure of Cold Rolled Magnesium Rods

Figure 1B:
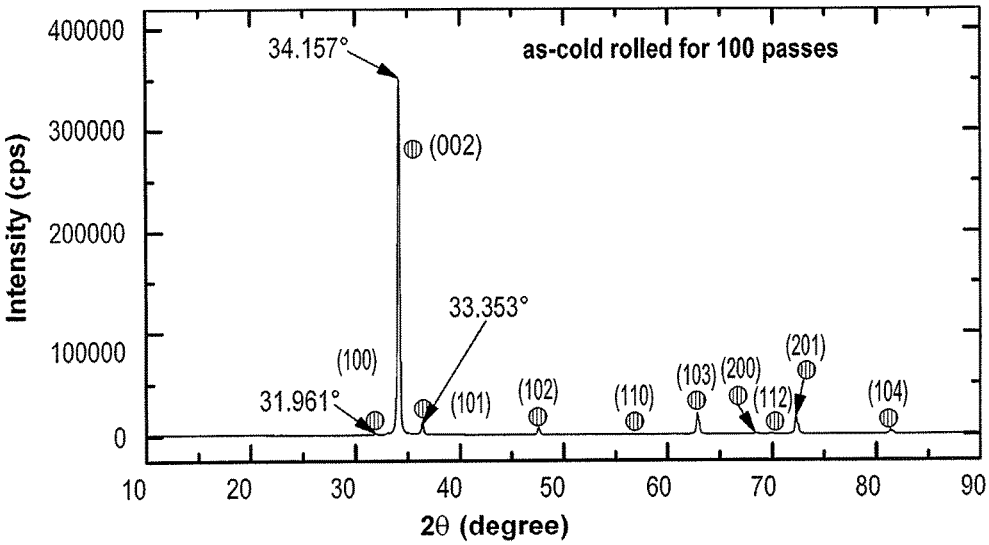
FIG. 1B is the X-ray diffraction (XRD) pattern of the magnesium rods after 100 cold rolling passes.
Figure 1C:
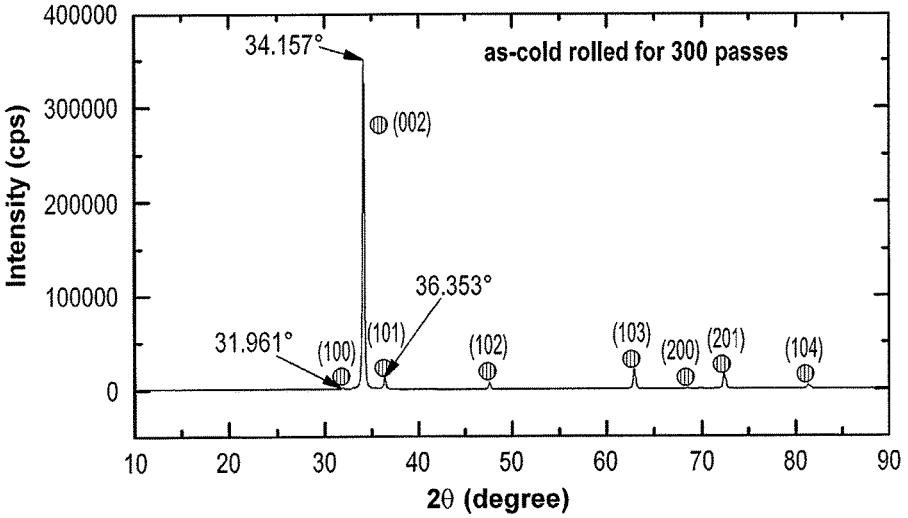
FIG. 1C is the X-ray diffraction (XRD) pattern of the magnesium rods after 300 cold rolling passes.

The crystal structure of each sample was investigated by X-ray diffraction (XRD) with CuKα radiation using a 9 kW X-ray diffraction system (Smartlab-Rigaku, Japan), as shown in FIGS. 1A-1C. The as-received Mg-sheet revealed typical hcp-structure corresponding to pure Mg metal, as shown by photomicrographs. The low magnification bright field image (BFI) of the plan view of a polished sample of as-received Mg indicates that the material contains large grains with an average grain size of 328 nm. At this low CR, Mg had twin-free grain boundaries, indicating the absence of any plastic deformations and lattice imperfections. After 10 cold rolling (CR) passes, lattice imperfections created clear deformations of the Mg grains and grain boundaries, visible in the bright field images. Dense dislocation walls were formed in the Mg due to the applied shear forces generated by the cold rolling process. Such metal-working, associated with plastic deformation, elongates the Mg grains, which tended to disintegrate into smaller grains. After 15 cold rolling passes, Mg grains appeared separated at their boundaries to form individual grains, as in FE-SEM micrographs. Moreover, these grains showed significant deformations parallel to the direction of the shear stresses applied by the roller drums. Significant grain imperfection, combined with refinements of Mg grains, occurred with increased cold rolling (20 CR passes, e.g.).

Increasing the CR passes to 25 caused severe plastic deformation in the hcp-Mg (131) lattice, as indexed by the formation of lamellar boundaries, visible in FE-SEM micrographs. FE-HRTEM images taken at the interfaces of these lamella indicate stacking faults beyond the nano level. A sample with CR of 50 passes had various lattice imperfections, i.e., twist boundaries and extrinsic dislocations. One image showed the formation of twin nuclei yielded by overlapping of a dissociated dislocation with a stacking fault at the grain boundaries of the Mg.

After CR of 100 passes, the peak position of the three major Bragg peaks, (100), (002) and (101) were shifted higher, as shown in FIG. 1B. A clear change in the intensity of the major crystallographic planes appears after this level of CR. Based on detailed TEM analysis, the intensity of some particular diffraction peaks, (002) as an example, appears related to a twinning volume fraction originating from crystal lattice reorientation during twinning. Deformation in hcp-metals (e.g. Mg) is typically accommodated by twinning and basal slip deformation mechanisms. No remarkable changes in the peak position of Mg was apparent after cold rolling for 300 passes, as shown in FIG. 1C.

The metal deformation associated by lattice imperfections led to disintegration of Mg grains into nanoscale equi-axed grains with an average grain size of 54 nm in diameter. Further grain refinement was achieved upon cold rolling of Mg for 300 passes, as indicated by the formation of ultrafine lenses less than 20 nm in diameter. When this sample was in-situ heated up to 230° C. under 10 bar of hydrogen gas pressure for 30 min, a mixture of nanocrystalline β- and γ-$MgH_2$ phases was obtained.

Example 4

Thermal Stability of Cold Rolled Magnesium

Figure 2A:
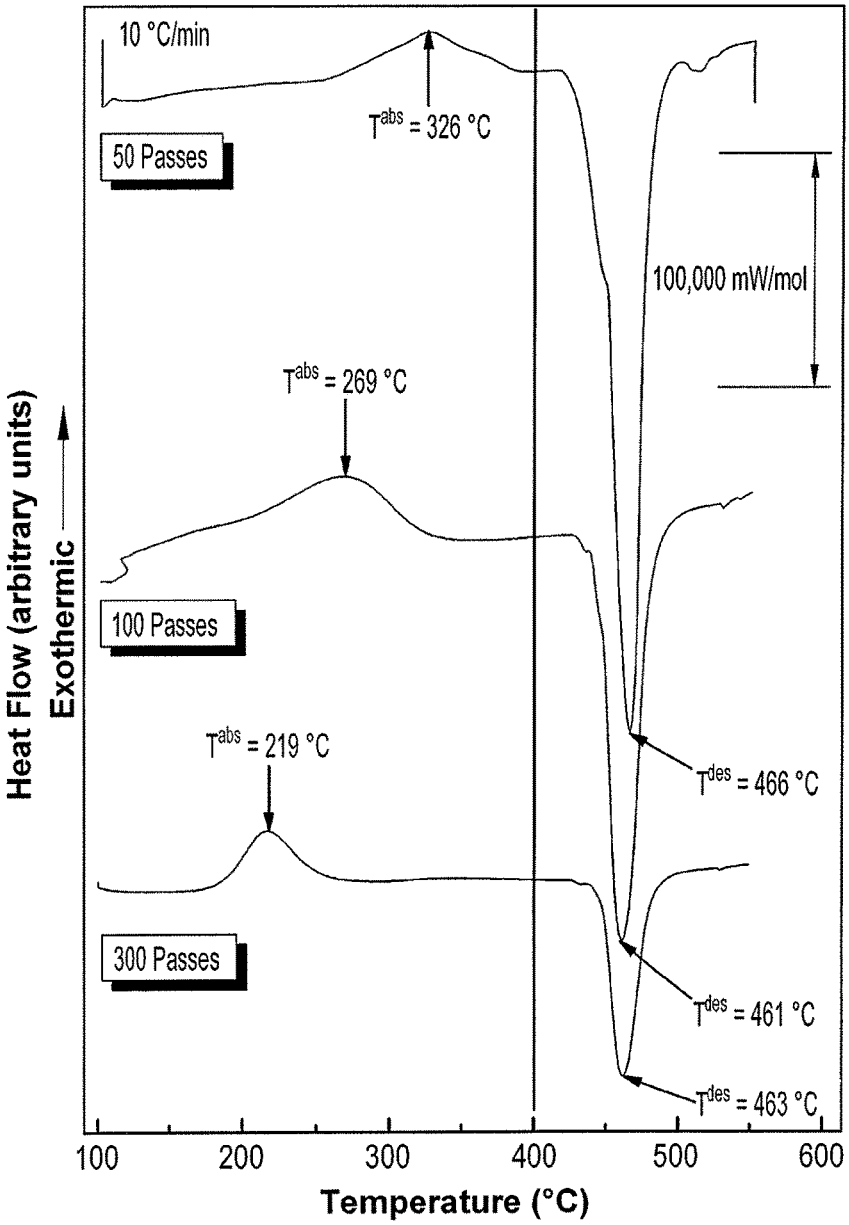
FIG. 2A is a composite plot of high pressure differential scanning calorimetry (HPDSC) conducted at 30 bar of $H_2$ with a heating rate of 10° C./min for Mg rods after 50, 100, and 300 cold rolling passes, respectively.

High-pressure differential scanning calorimetry (HP-DSC) traces conducted under 30 bar of hydrogen gas atmosphere with a heating rate of 10° C./min for cold-rolled Mg-rods obtained after 50, 100 and 300 passes, are shown in FIG. 2A. The low temperature exothermic peaks correspond to the hydrogenation reaction, and the high temperature sharp endothermic peaks correspond to the dehydrogenation reaction of $MgH_2$ phase. All traces presented in FIG.

Figure 3A:
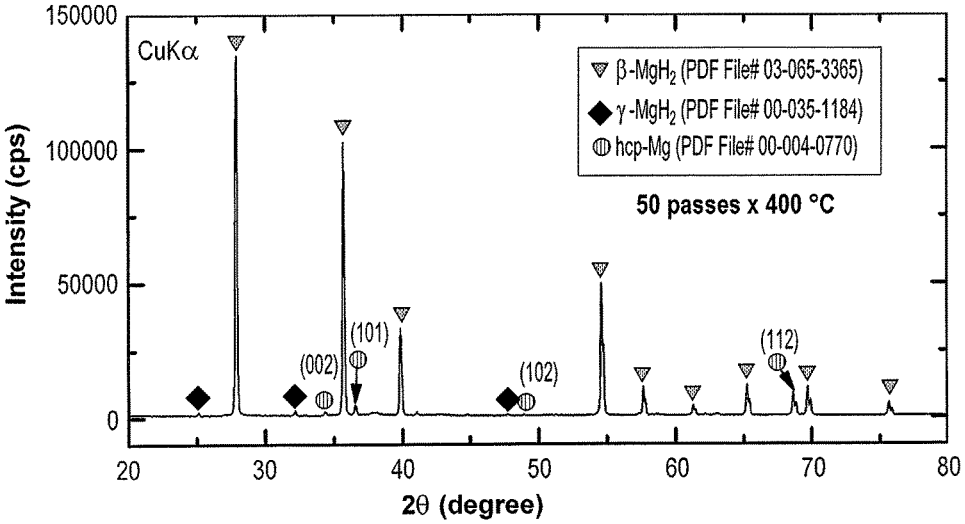
FIG. 3A is the XRD diffractogram of Mg rods after cold rolling for 50 passes, and then heating up to 400° C. during HPDSC experiments.
Figure 3B:
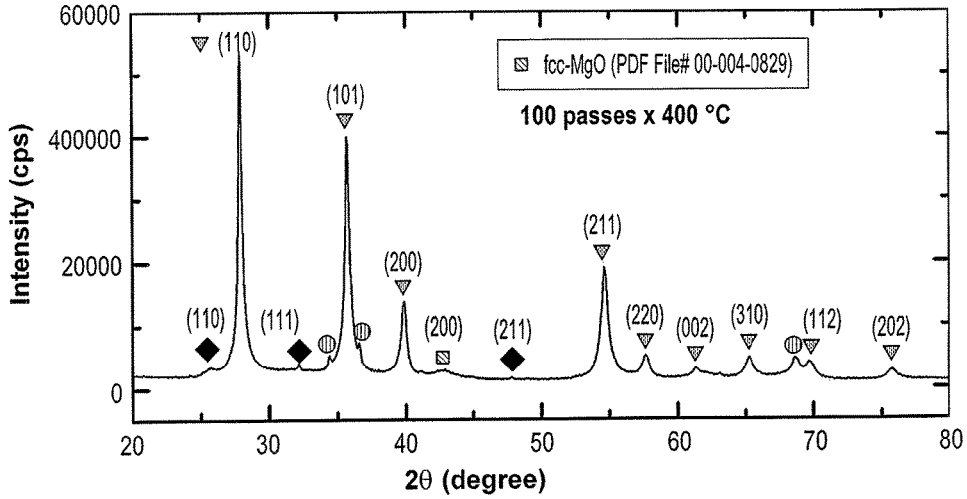
FIG. 3B is the XRD diffractogram of Mg rods after cold rolling for 100 passes, and then heating up to 400° C. during HPDSC experiments.
Figure 3C:
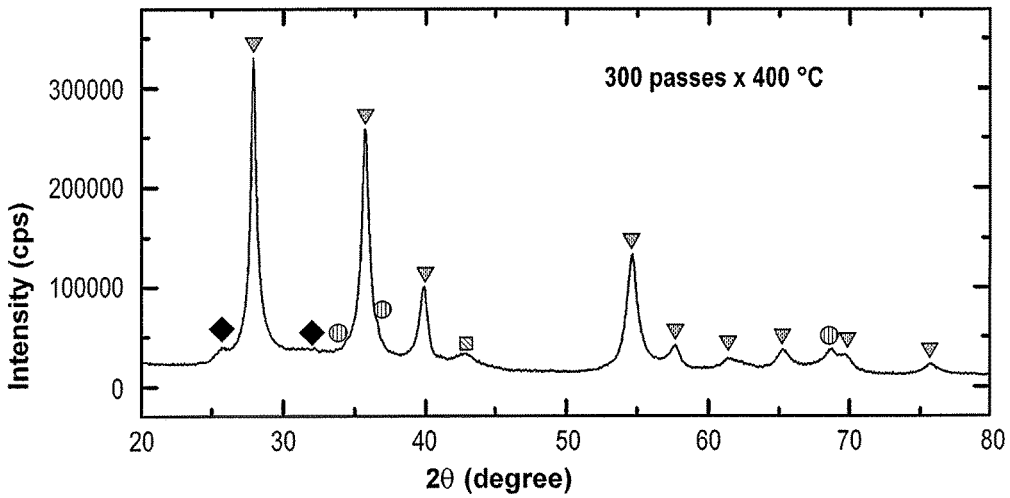
FIG. 3C is the XRD diffractogram of Mg rods after cold rolling for 300 passes, and then heating up to 400° C. during HPDSC experiments.

2A show two events; the first are exothermic reactions appearing at <400° C., and the second events are endothermic at >400° C. The first events are related to exothermic reactions taking place between Mg metal and hydrogen gas. This was confirmed by heating the samples of 50, 100 and 300 passes up to 400° C. and then cooling them down to room temperature. Then crystal structures of the samples were investigated by XRD. The results indicated that the volume fraction of $MgH_2$ phases (β and γ) increased with increasing cold rolling passes, as shown in FIGS. 3A-3C. The XRD pattern of the sample obtained after 50 CR and then heated up to 400° C. under 30 bar of hydrogen shows the formation of sharp Bragg-peaks related to β- and γ-$MgH_2$ phases coexisted with small volume fractions of pure hcp-Mg, as shown in FIG. 3A. The sample obtained after 100 passes and then hydrogenated in the HPDSC showed broad to β- and γ-$MgH_2$. Bragg-peaks, suggesting the formation of finer $MgH_2$ grains (FIG. 3B). Further broadening seen in the β- and γ-$MgH_2$ Bragg-peaks combined with decrease in the peaks' intensity is notable for the sample obtain after 300 CR passes, as shown in FIG. 3C.

Increasing the CR passes increases the formation of nanocrystalline Mg grains, as confirmed by TEM observations. When these fine grains enter a hydrogenation reaction, nano-$MgH_2$ grains are obtained. In addition, increasing the number of CR passes from 50 to 100 times significantly decreases the hydrogenation temperature from 326° C. (upper trace FIG. 2A) to 269° C. (middle trace in FIG. 2A). Further increasing the CR to 300 passes further decreases the hydrogenation temperature to 219° C., as in the lower trace of FIG. 2A. Thus, it appears that the lattice imperfections caused by cold rolling enhance the gas-solid reaction between Mg and hydrogen, lowering the reaction temperature with increasing CR passes. This behavior is likely a result of the quantum effect suggested for nano-Mg grains. As the rolling time increases, the Mg-grains re continuously refined and subdivided into finer grains. Thus, the number of atoms located on the surface of Mg grains increase per volume, while the number of Mg atoms located at the core of the grains decrease. Increasing the volume fraction ratio of Mg atoms located at the surface to the atoms occupying the grains' core enhances the hydrogenation reaction and facilitates an easier reaction process, consistent with the dramatic decrease in the gas-solid reaction between Mg and hydrogen.

The endothermic peaks, indicative of the dehydrogenation process, do not show any obvious changes with increasing the CR passes. This tendency of the endothermic peaks was affected by the high hydrogen pressure (30 bar) applied to the $MgH_2$ grains. As these fine particles are surrounded by hydrogen gas at high pressure, the hydrogen stored in the particles was trapped and requires the application of high temperatures to be released, presumably.

Figure 2B:
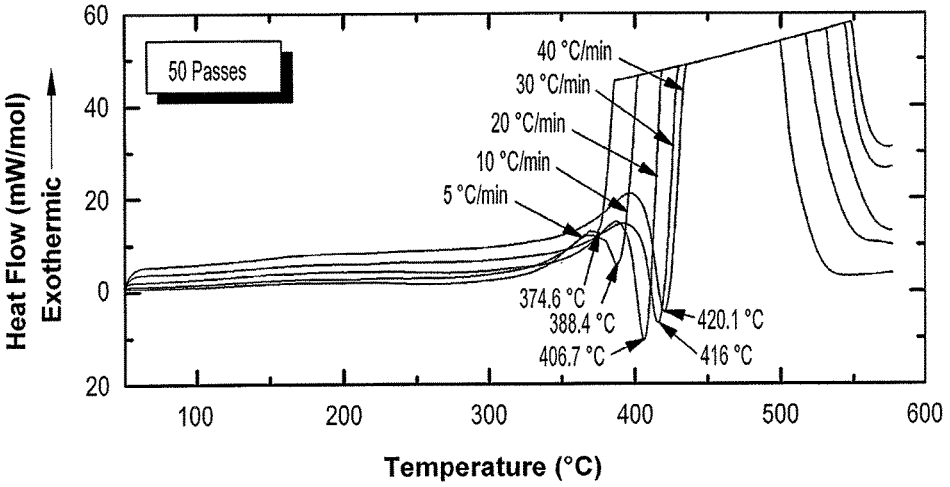
FIG. 2B is a composite plot of DSC conducted at 1 bar of He pressure with different heating rates (5, 10, 20, 30, 40° C./min) for Mg rods after 50 passes of cold rolling.

In order to investigate the effect of CR passes on the dehydrogenation of the $MgH_2$ obtained after heating up the cold rolled samples to 400° C. in HPDSC under 30 bar hydrogen pressure, normal DSC operated under He atmospheric pressure was conducted. The DSC traces of as-cold rolled Mg for 100 passes time conducted at different heating rates are shown in FIG. 2B. All samples showed endothermic peaks, with peak temperature ranging between 374.6° C. to 420.1° C., depending on the applied heating rates.

Different DSC experimental sets were performed for different heating rates, and the activation energy (Ea) of decomposition was calculated using the Arrhenius equation (Eq. 1):

$$E_a = RT\ln(k) \quad (1)$$

where k is a temperature-dependent reaction rate constant, R is the gas constant, and T is the absolute temperature. The value $E_a$ of the reaction was determined by measuring the decomposition peak temperature (Tp) corresponding to the respective heating rates and then plotting ln(k) versus 1/Tp. The high pressure DSC (HPDSC) (Setaram Instrumentation, France) was employed using 30 bar of hydrogen gas atmosphere for the different heating rates in order to determine the activation energy of hydrogenation.

Figure 2C:
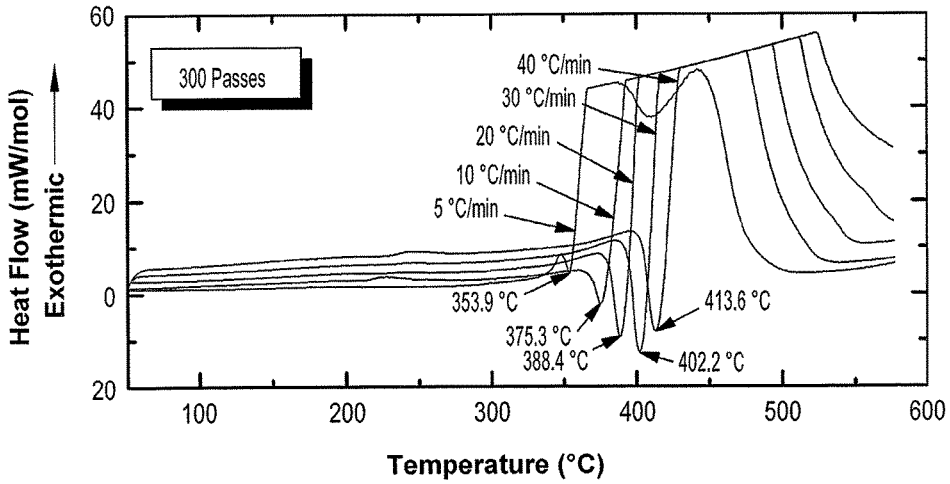
FIG. 2C is a composite plot of DSC conducted at 1 bar of He pressure with different heating rates (5, 10, 20, 30, 40° C./min) for Mg rods after 300 passes of cold rolling.

The apparent activation energy ($E_a$) calculated by the Arrhenius approach indicates a marginal decreasing of $E_a$, dropping from 142.8 kJ/mole (5 passes) to 134.6 kJ/mol (50 passes). Increasing the cold rolling process to 300 passes (FIG. 2C) led to a remarkable decrease of $E_a$ to 112.4 kJ/mol, Increasing cold rolling passes in the present method apparently leads to superior hydrogenation behaviors of $MgH_2$, with more limited improvement on the corresponding dehydrogenation process.

Example 5

Characterization of Mg Cold Sprayed with Nickel

Cold spray Ni coating for doping the cold rolled Mg rods with Ni particles was employed. This process can be successfully utilized for doping Mg with different catalysts other that Ni powders, including pure metals (e.g., Fe, Cr, Ti, V, Zr, Nb, Ta, Cu), their oxides (e.g., $Fe_2O_3$, $TiO_2$, $V_2O_5$, $ZrO_2$, $Nb_2O_5$, $Ta_2Os$), intermetallic alloys (Ti-based, Zr-based, V-based, Fe-based, Ni-based), amorphous and metallic glasses (Ti-based, Zr-based, V-based, Fe-based, Ni-based) and refractory compounds (TiC, ZrC, VC, NbC, TaC, SiC, B-based) powders.

The morphology of cold-rolled Mg rods after 300 passes by scanning electron microscopy imaging before cold spraying with Ni powders and after cold spraying with up to 5.28 wt. % Ni powders. The Ni powders were plastically deformed on the surface of the Mg strips to develop a rather porous coating layer. The cold spraying process did not lead to any grain growth of the Ni powders, as indicated by the similar particle sizes of the powders before and after the coating process. In addition, Ni powders were homogeneously distributed on the Mg surfaces.

In order to improve the weldability of Ni powder deposited on the Mg ribbon surfaces and to obtain a homogeneous Ni coating, some of the cold sprayed Mg strips were cold rolled gently at room temperature for 30 times, as described in Example 2.

Micrographs of 300-pass cold rolled Mg ribbon showed that the coating Ni layer was well distributed on the Mg surface with no apparent porosity or uncoated zones. This indicates the importance of cold rolling the Mg-strips after cold spray coating with Ni powder for improving the morphology and topological characterization of Mg strips.

Figure 4A:
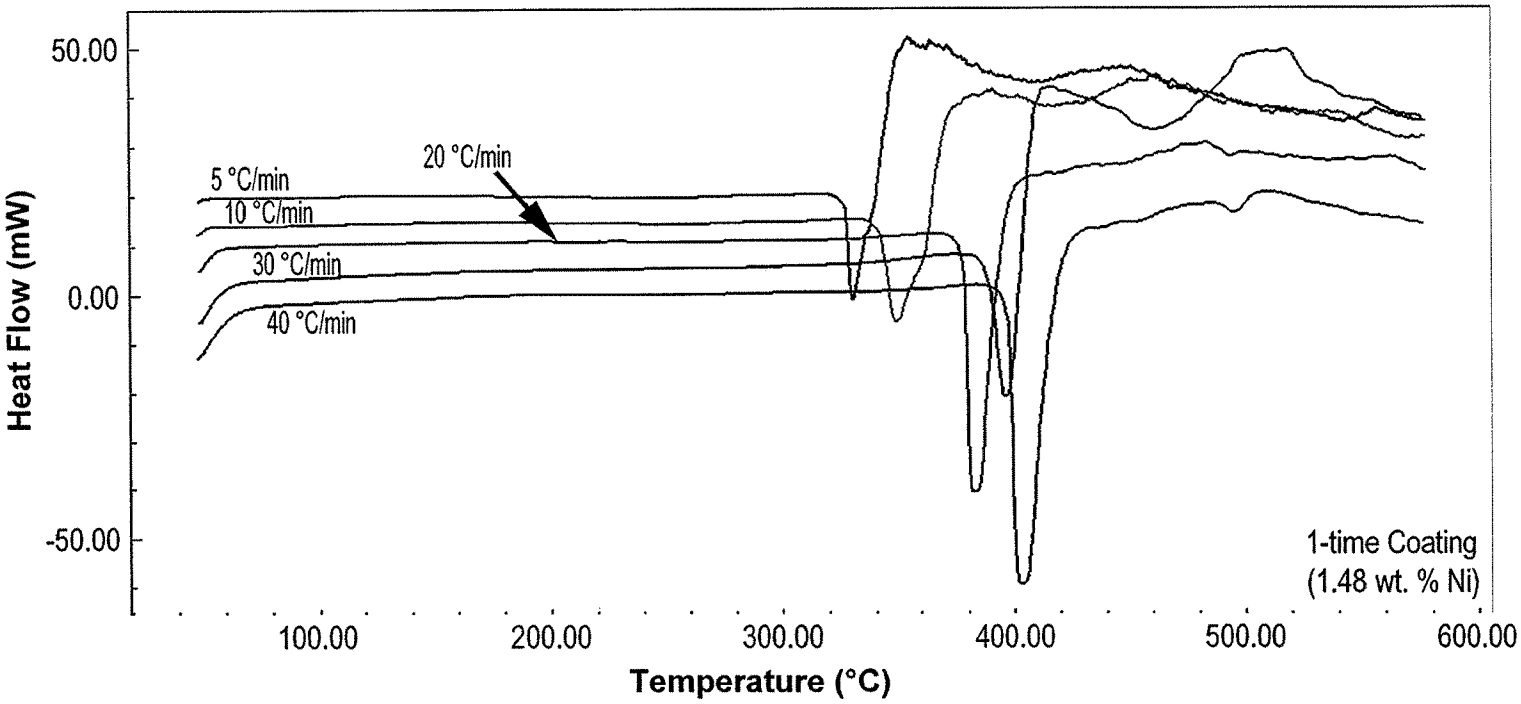
FIGS. 4A, 4B, and 4C are DSC thermograms obtained with different heating rates of cold rolled Mg rods after cold spraying with Ni once, twice, and three times, respectively.
Figure 4B:
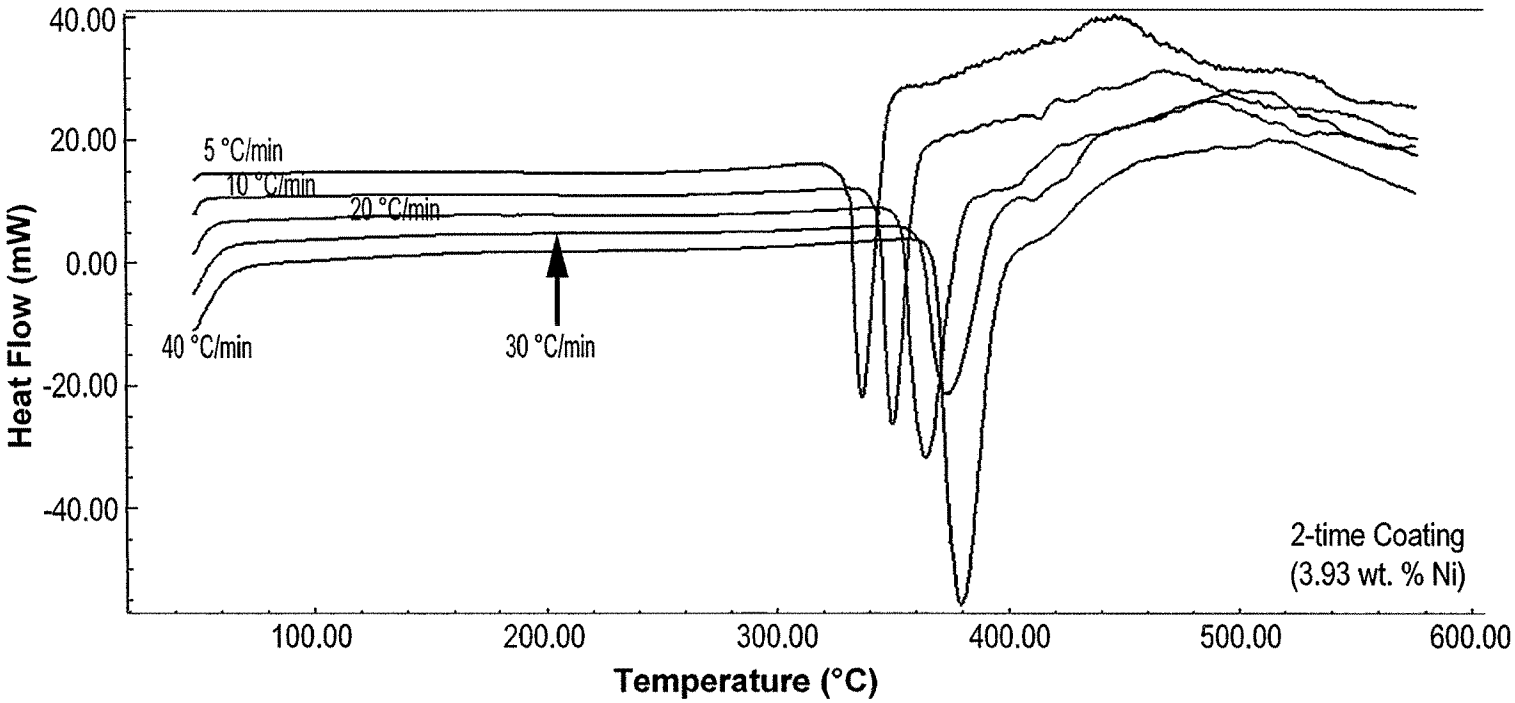
Figure 4C:
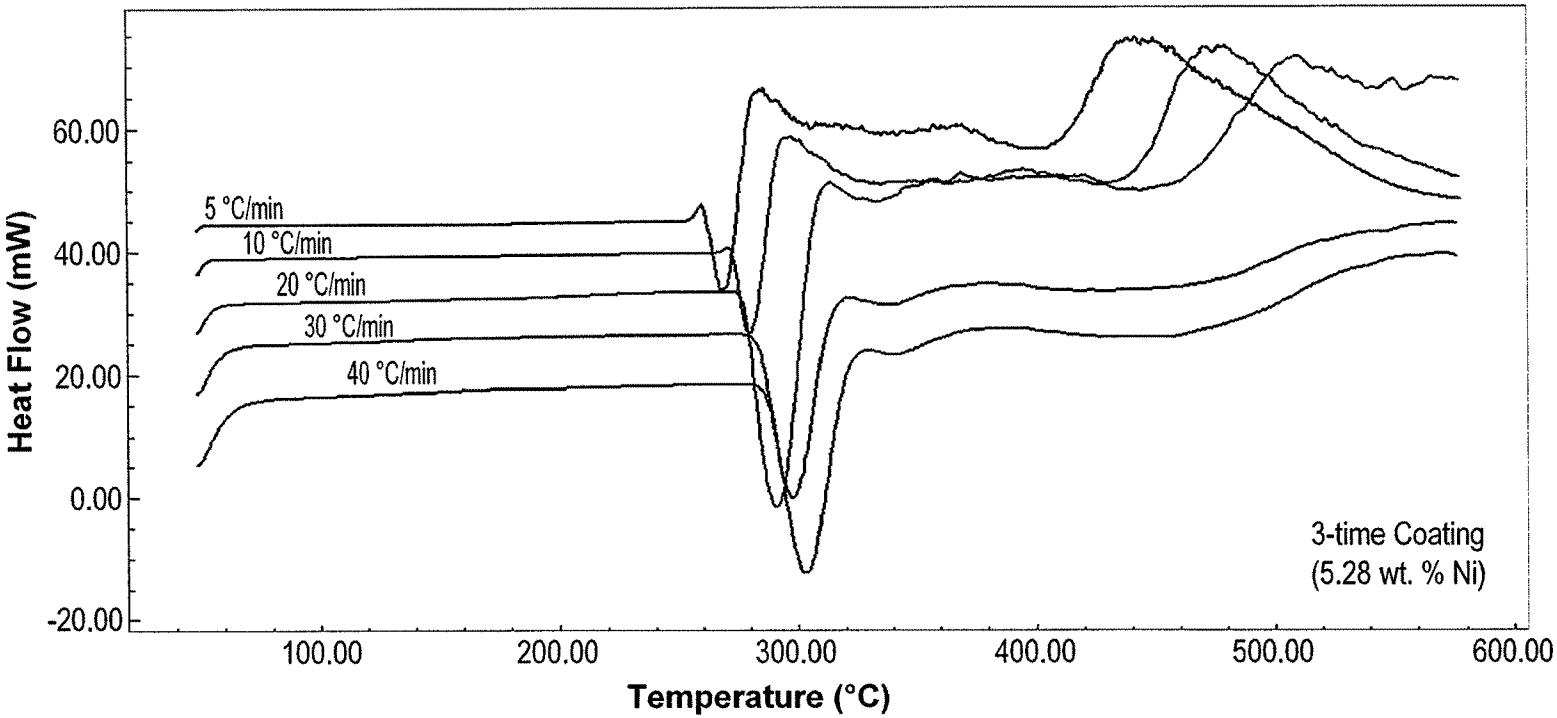

The DSC curves in hydrogen atmosphere for Ni-doped Mg material obtained after 300 CR passes and then doped with Ni powder are shown in FIGS. 4A-4C, using cold spray coating once (FIG. 4A), twice (FIG. 4B) and three times (FIG. 4C). Elemental analysis, using FE-SEM/EDS technique was conducted to determine the concentration of Ni deposited on the Mg surfaces after the selected coating times. The results show that increasing the coating time from 1 time to 2 times increases the Ni concentration from 1.48 to 3.93 wt. %. Further increasing to 3 times, the Ni concentration increased to 5.28 wt. %. In FIG. 4A (1-time coating, 1.48 wt. % Ni) the peak decomposition temperature of $MgH_2$ obtained at a heating rate of 20° C./min is about 380° C. Comparing this value with the sample before coating (388.4° C.), shown in FIG. 2C, the concentration of Ni (1.48 wt. % Ni) from a single time coating mildly decreases the decomposition temperature. Increasing the coating to 2 times (3.93 wt. % Ni) lead to a moderate improvement in the decomposition temperature of $MgH_2$ to 364° C., as shown in FIG. 4B. In contrast to those cold-sprayed samples corresponding to 1 and 2 Ni coating times, coating the Mg ribbon 3 times (5.28 wt. % Ni) led to superior improvement in the decomposition characteristics over $MgH_2$, tending to release hydrogen content through an obvious endothermic peak that appeared at 288° C. with a heating rated of 20° C./min, as shown in FIG. 4C. Moreover, the apparent activation energy of this nanocomposite sample decreased (74 kJ/mole) relative to the uncoated Mg sample (134.6 kJ/mol).

The effect of cold rolling and cold-spray Ni powder doping on the kinetics of hydrogenation (hydrogen uptake) and dehydrogenation (hydrogen release) of Mg was investigated. Hydrogen absorption/desorption kinetics were investigated using Sievert's method under a hydrogen gas pressure ranging between 200 mbar and 8 bar. The hydrogenation and dehydrogenation processes were examined at 150° C./8-10 bar and 200° C./200 mbar, respectively. For the purpose of the present work, 6 individual batches of $MgH_2$-based materials obtained with different approaches were examined. The batches are as follows: as-received Mg feedstock rods (before rolling); cold rolled Mg-rods for 300 passes; reactive ball milled Mg powders doped with 5.5 wt. % Ni under 50 bar of $H_2$ for 50 h; and 300 pass cold rolled Mg-rods cold sprayed with Ni in concentrations of 1.48 wt. % (1-spraying coating time), 3.93 wt. % (2-spraying coating time), and 5.28 wt. % (3-spraying coating time), respectively.

Figure 5A:
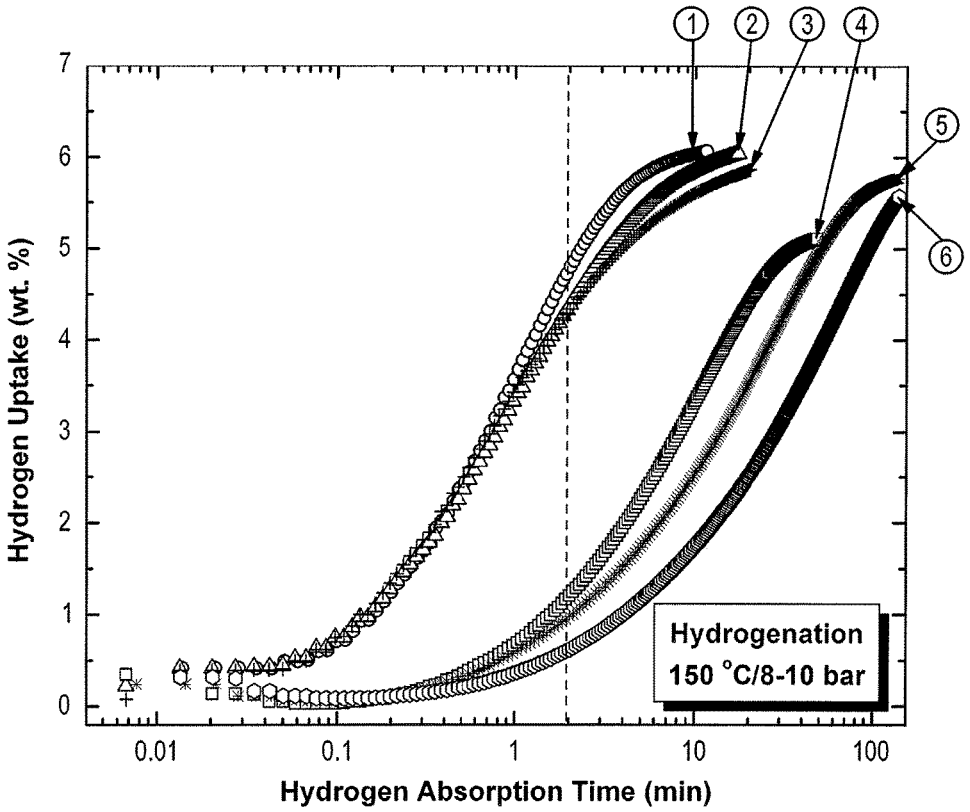
FIG. 5A is a plot of hydrogen uptake (wt %) as a function of hydrogen absorption time (minutes) at 150° C./8 bar of pressure for different Mg-based samples prepared in different conditions, 1-6, where trace 1 refers to 300 pass cold rolled Mg rods cold sprayed with 5.28 wt. % Ni powder and then cold rolled for 30 passes; trace 2 refers to 300 pass cold rolled Mg rods cold sprayed with 3.93 wt. % Ni powder and then cold rolled for 30 passes; trace 3 refers to 300 pass cold rolled Mg rods cold sprayed with 1.48 wt. % Ni powders and then cold rolled for 30 passes; trace 4 refers to 300 pass cold rolled Mg rods; trace 5 refers to reactive ball milled Mg/(5.5 wt. % Ni) powder, ball milled for 50 h under 50 bar of $H_2$; and trace 6 refers to as-received Mg rods, demonstrating hydrogenation kinetics.

The hydrogenation kinetics behaviors of the 6 batches of $MgH_2$-based materials are presented in FIG. 5A. As shown in the drawing, all the samples from the different batches showed an ability for absorbing hydrogen under this relatively low temperature (150° C.), but with different time scales. The as-received Mg-rods showed slow uptake kinetics, indicated by the long time (2 min) to absorb 0.9 wt. % $H_2$, and 144.6 min to fully absorb 5.8 wt. % $H_2$. The as-doped Mg powders with 5.5 wt. % Ni and reactively ball milled under hydrogen for 50 h did not show further improvement on hydrogenation kinetic, indexed by the long time (142.8 min) required to absorb about 5.6 wt. % $H_2$, being nearly similar to the feed stock Mg-rods. During the first 2 min of hydrogenation process, the 300 CR pass sample showed minor hydrogenation kinetics improvement (1.2 wt. % $H_2$). However, it showed obvious enhancement of hydrogen uptake after 50 min, indicated by its capability to absorb 5.1 wt. % $H_2$.

The Mg-strips obtained by cold rolling for 300 passes and then cold spray coated with different concentrations of Ni powders, and finally cold rolled for 30 passes showed pronounced improvement on hydrogenation kinetics. After only 2 min of the hydrogenation process, the samples doped with 1.48, 3.93 and 5.28 wt. % Ni absorbed 4.2, 4.35, 4.8 wt. % $H_2$, respectively, and saturated at around 5.6, 6, and 5.1 wt. % $H_2$ after 21.1, 17.6, and only 5.1 min, respectively.

Figure 6A:
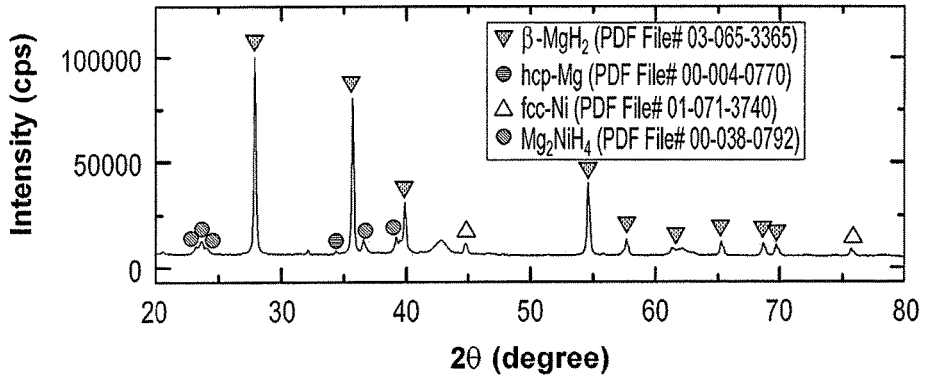
FIGS. 6A, 6B are XRD diffractogram patterns after hydrogenation and dehydrogenation, respectively, of cold-rolled Mg coated three-times with Ni powders before cold rolling again for 30 times.
Figure 6B:
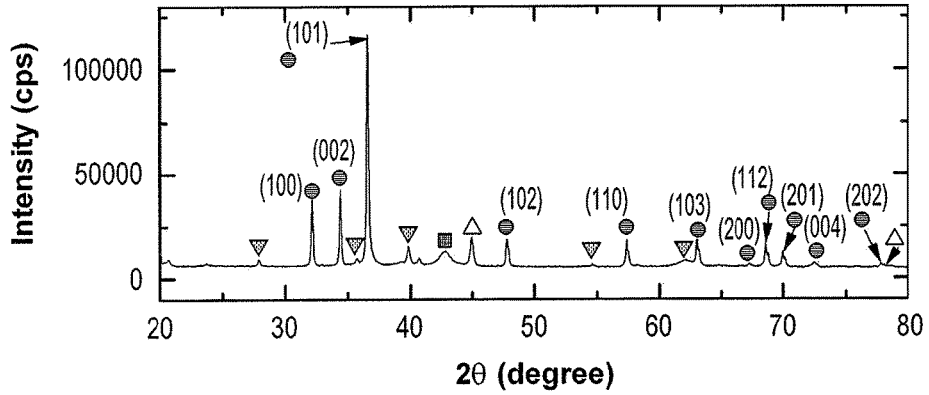

The XRD pattern of the exemplary Mg ribbon coated with 5.28 wt. % Ni after completing the hydrogenation process at 150° C./8-10 bar of hydrogen for 5.1 min is presented in FIG. 6A. The sample reveals pronounced Bragg-peaks related to β-MgH2 phase coexisting with a minor volume fraction of unreacted Mg. The rather broad Bragg lines shown in FIG. 6A are likely related to the Ni coating material. The very small volume fraction of $Mg_2NiH_4$ phase observed was likely due to the reaction conducted between $MgH_2$ and Ni during the hydrogenation process.

Figure 5B:
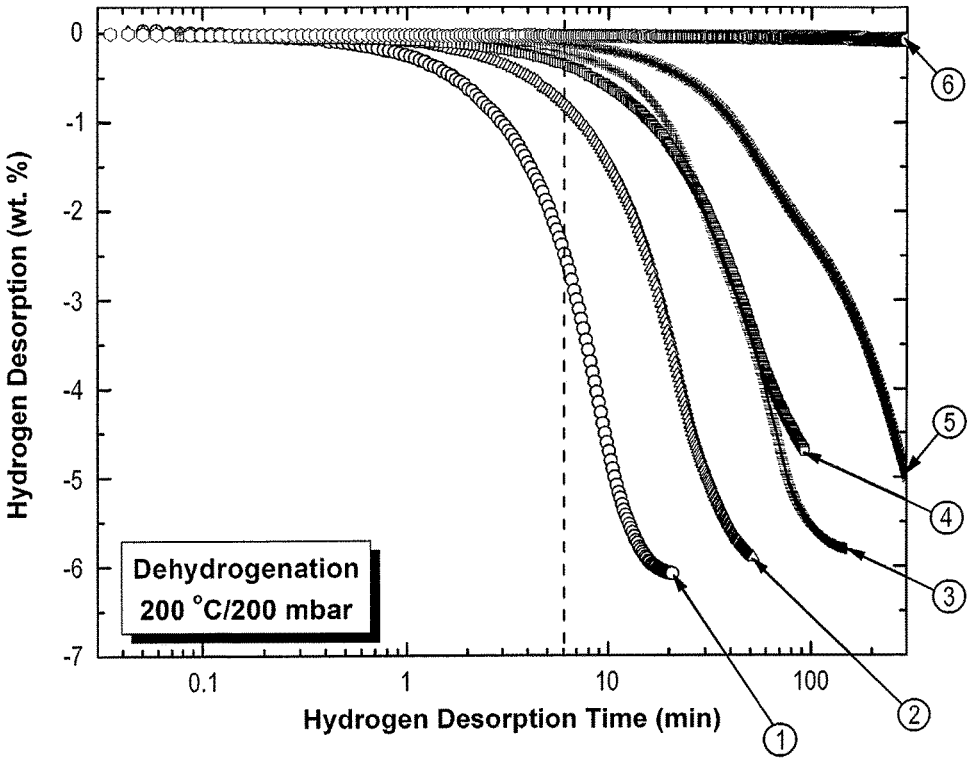
FIG. 5B is a plot of hydrogen desorption (wt %) as a function of hydrogen desorption time (minutes) at 200° C./200 mbar of pressure for different Mg-based samples prepared in different conditions, 1-6, where trace 1 refers to 300 pass cold rolled Mg rods cold sprayed with 5.28 wt. % Ni powder and then cold rolled for 30 passes; trace 2 refers to 300 pass cold rolled Mg rods cold sprayed with 3.93 wt. % Ni powder and then cold rolled for 30 passes; trace 3 refers to 300 pass cold rolled Mg rods cold sprayed with 1.48 wt. % Ni powders and then cold rolled for 30 passes; trace 4 refers to 300 pass cold rolled Mg rods; trace 5 refers to reactive ball milled Mg/(5.5 wt. % Ni) powder, ball milled for 50 h under 50 bar of $H_2$; and trace 6 refers to as-received Mg rods, demonstrating dehydrogenation kinetics.

FIG. 5B presents the corresponding dehydrogenation kinetics of the six batches of Mg materials discussed above. All the samples showed an ability to release their stored hydrogen, with only the as-received Mg-rods failing to complete the dehydrogenation reaction, even after 301 min. The as-doped Mg powders with 5.5 wt. % Ni and reactively ball milled under hydrogen for 50 h showed limited improvement on dehydrogenation kinetic, indexed by the rather long time (301 min) required to release about 5 wt. % $H_2$. During the first 6 min of dehydrogenation, the 300 CR pass sample did not reflect significant dehydrogenation kinetics improvement (−0.3 wt. % $H_2$). However, it showed significant enhancement of hydrogen release after 90.1 min, indicated by its capability to desorb 4.7 wt. % $H_2$.

The Mg-strips obtained upon cold rolling for 300 passes and then cold spray coated with different concentrations of Ni powders showed pronounced improvement on dehydrogenation kinetics. After only 6 min of the dehydrogenation process, the samples doped with 3.93 and 5.28 wt. % Ni desorbed significantly (−0.8 and −2.3 wt. % $H_2$, respectively). The Mg-strips obtained upon cold rolling for 300 passes, then cold spray coated with different concentrations of Ni powders, and then cold rolled for 30 passes achieved near full desorption levels, the 1.48 wt % nickel coating desorbing 4.7 wt % H2 in 153.5 min, the 3.93 wt % nickel coating desorbing 5.9 wt % H2 in153.5 min, and the 5.28 wt % nickel coating desorbing 6.1 wt % $H_2$ after only 21.1 min, respectively.

The cycle-life-time of the samples prepared by cold-rolling Mg-rods for 300 passes, spraying with Ni powder for three-times, and cold rolling again for 30 times were tested for 318 h (600 charging/discharging cycles) at 200° C., with hydrogenation/dehydrogenation pressures of 10 bar and 200 mbar, respectively.

The Mg-strips coated with Ni were first activated by applying cyclic hydrogen gas sorption/desorption for 65 continuous cycles. This treatment was necessary for surface cleaning of the material and to break down the oxide phase (MgO) formed on the powder surfaces. This system exhibited excellent cyclic-reversible behavior, evinced by cyclic stability after at least 318 h.

In summary, the presently disclosed method employs a very cheap process, using a cold rolling technique to produce thin Ni-doped Mg material from commercial Mg. This process, which is very cheap and does not require electric power, can be scaled up and used for preparing bulk nanostructured Ni-doped Mg-strips/sheets that can easily absorb hydrogen at lower temperature and pressure. Further, fabrication of Ni-doped Mg as described herein will solve the oxidation problem of Mg/MgH2 when handled in normal atmosphere. The method herein improves upon the results of the expensive and power-consuming high-energy ball milling technique and can match the required demands of industry.

It is to be understood that the present invention is not limited to the embodiments described above, but encompasses any and all embodiments within the scope of the following claims.

We claim:

1. A method for doping magnesium with nickel by cold spray technique, comprising the steps of:

cold rolling pure magnesium material, wherein the step of cold rolling the pure magnesium material comprises cold rolling the pure magnesium material for at least three hundred passes through the rollers;

cold spraying the cold-rolled magnesium material with a nickel powder to form a nickel-doped magnesium material, wherein the nickel-doped magnesium material contains a nickel weight percentage of at least 5%; and cold rolling the nickel-doped magnesium material, wherein the cold rolling of the nickel-doped magnesium material is for at least thirty passes through the rollers.

2. The method for doping magnesium of claim 1, wherein the pure magnesium material is bulk magnesium metal with a purity of at least 99 wt. %.

3. The method for doping magnesium of claim 1, wherein the nickel powder has an average particle size of around 10 μm.

4. The method for doping magnesium of claim 1, further comprising the step of straightening the cold-rolled magnesium material to a straight flat ribbon before the cold spraying step.

* * * * *